US010347181B2

(12) United States Patent
Zhu et al.

(10) Patent No.: US 10,347,181 B2
(45) Date of Patent: Jul. 9, 2019

(54) DISPLAY PANEL, DISPLAY DEVICE, AND METHOD FOR DRIVING A PIXEL CIRCUIT

(71) Applicant: SHANGHAI TIANMA AM-OLED CO., LTD., Shanghai (CN)

(72) Inventors: Renyuan Zhu, Shanghai (CN); Zeyuan Chen, Shanghai (CN)

(73) Assignee: SHANGHAI TIANMA AM-OLED CO., LTD., Shanghai (CN)

( * ) Notice: Subject to any disclaimer, the term of this patent is extended or adjusted under 35 U.S.C. 154(b) by 0 days.

(21) Appl. No.: 15/728,516

(22) Filed: Oct. 10, 2017

(65) Prior Publication Data

US 2018/0047337 A1 Feb. 15, 2018

(30) Foreign Application Priority Data

Apr. 28, 2017 (CN) ..... 2017 1 0297369

(51) Int. Cl.
*G09G 3/3233* (2016.01)

(52) U.S. Cl.
CPC ... *G09G 3/3233* (2013.01); *G09G 2300/0814* (2013.01); *G09G 2300/0819* (2013.01); *G09G 2300/0842* (2013.01); *G09G 2300/0861* (2013.01); *G09G 2310/0245* (2013.01); *G09G 2310/0262* (2013.01); *G09G 2320/0209* (2013.01); *G09G 2320/0233* (2013.01); *G09G 2330/02* (2013.01)

(58) Field of Classification Search
CPC ... G09G 2320/0233; G09G 2320/0204; G09G 2320/045
See application file for complete search history.

(56) References Cited

U.S. PATENT DOCUMENTS

2005/0140605 A1* 6/2005 Jung ..... G09G 3/3233 345/76
2014/0168180 A1* 6/2014 Kim ..... H05B 33/0896 345/205

(Continued)

FOREIGN PATENT DOCUMENTS

CN 103137067 A 6/2013
CN 102254510 B 9/2014

(Continued)

*Primary Examiner* — Dong Hui Liang
(74) *Attorney, Agent, or Firm* — Kilpatrick Townsend & Stockton, LLP

(57) ABSTRACT

The disclosure discloses a display panel, a display device, and a method for driving a pixel circuit, and the pixel circuit includes a data writing module, a light-emission control module, a driver control module, a threshold compensation module, an anode resetting module, a node initialization module, and an organic light-emitting diode. The threshold compensation module can compensate for drifting of threshold voltage of the driver transistor so that the pixel circuit can emit light and display while operating current of the driver transistor to drive the light-emitting element to emit light is only dependent upon a signal on the data line and voltage at a reference signal end, but independent of the threshold voltage and a first power source voltage end to thereby avoid the threshold voltage and an IR drop from affecting the current flowing through the organic light-emitting diode.

18 Claims, 13 Drawing Sheets

(56) References Cited

U.S. PATENT DOCUMENTS

| | | | | |
|---|---|---|---|---|
| 2016/0027379 | A1* | 1/2016 | Chen | G09G 3/3233 345/698 |
| 2017/0025062 | A1* | 1/2017 | Wang | G09G 3/3233 |
| 2017/0069264 | A1* | 3/2017 | Dai | G09G 3/3233 |

FOREIGN PATENT DOCUMENTS

| | | | |
|---|---|---|---|
| CN | 104933993 | A | 9/2015 |
| CN | 105185305 | A | 12/2015 |
| CN | 106023900 | A | 10/2016 |
| JP | 2014219521 | A | 11/2014 |
| KR | 20150079003 | A | 7/2015 |

* cited by examiner

-- Prior Art --

DISPLAY PANEL, DISPLAY DEVICE, AND METHOD FOR DRIVING A PIXEL CIRCUIT

CROSS-REFERENCE TO RELATED APPLICATIONS

This application claims the priority to Chinese Patent Application No. 201710297369.7, filed on Apr. 28, 2017, the content of which is hereby incorporated by reference in its entirety.

FIELD

The present disclosure relates to the field of display technologies, and particularly to a display panel, a display device, and a method for driving a pixel circuit.

BACKGROUND

An Organic Light-Emitting Diode (OLED) display is one of focuses in the field of researches on tablet displays at present, and the OLED display has the advantages of low energy consumption, a low production cost, self-luminescence, a wide angle of view, a high response speed, etc., compared with a liquid crystal display. At present, the OLED display has come to take the place of the traditional Liquid Crystal Display (LCD) in the field of flat panel displays such as mobile phones, PDAs and digital cameras, where the design of a pixel circuit is a core aspect in the OLED display, so the researches thereon are highly significant.

Unlike the LCD in which the brightness is controlled using stable voltage, the OLED is current-driven, so it needs to be controlled by stable current to emit light. Threshold voltage Vth of a driver transistor in the pixel circuit may be non-uniform due to reasons such as a fabrication process thereof, and aging of elements thereof, so that the current flowing through the OLEDs at the respective pixels may vary, thus resulting in non-uniform display brightness, which may degrade the display effect of the entire image.

SUMMARY

An embodiment of the disclosure provides a display panel including a plurality of pixel circuits, and first scan lines, second scan lines, data lines, and light-emission control lines, corresponding to the pixel circuits. Each of the pixel circuits includes a data writing module, a light-emission control module, a driver control module, a threshold compensation module, an anode resetting module, a node initialization module, and an organic light-emitting diode. The data writing module includes a first transistor and a second transistor, and the first transistor has a gate connected with the second scan line, a first electrode connected with the data line, and a second electrode connected with a first node; and the second transistor has a gate connected with the light-emission control line, a first electrode connected with a reference signal end, and a second electrode connected with the first node. The light-emission control module includes a third transistor, and the third transistor has a gate connected with the light-emission control line, a first electrode connected with a third node, and a second electrode connected with a fourth node. The driver control module includes a driver transistor, and the driver transistor has a gate connected with a second node, a first electrode connected with a first power source voltage end, and a second electrode connected with the third node. The threshold compensation module includes a fourth transistor and a capacitor, and the fourth transistor has a gate connected with the second scan line, a first electrode connected with the second node, and a second electrode connected with the third node; and the capacitor is connected between the first node and the second node. The anode resetting module includes a fifth transistor, and the fifth transistor has a gate connected with the first scan line or the second scan line, a first electrode connected with an initial signal end and a second electrode connected with the fourth node. The organic light-emitting diode is connected between the fourth node and a second power source voltage end. The node initialization module has a control end connected with the first scan line, an input end connected with the initial signal end, and an output end connected between the third node and the second node; and the node initialization module is configured to be controlled by the control end thereof to provide the output end thereof with a signal received at the input end thereof.

Correspondingly an embodiment of the disclosure further provides a display device including the display panel according to the embodiment above of the disclosure.

Correspondingly an embodiment of the disclosure further provides a method for driving a pixel circuit in the display panel according to the embodiment above of the disclosure, the driving method including the following steps. In an initialization stage, the first transistor in the data writing module is switched on to write a signal of the data signal end into the first node; the fifth transistor in the anode resetting module is switched on to provide the fourth node with a signal of the initial signal end; the fourth switch transistor in the threshold compensation module is switched on to connect the second node with the third node; and the node initialization module provides the second node with the signal of the initial signal end. In a threshold detection stage, the first transistor in the data writing module is switched onto write a signal of the data signal end into the first node; the fourth switch transistor in the threshold compensation module is switched on to connect the second node with the third node; the driver transistor in the driver control module is switched on to provide the second node with a signal of the first power source voltage end through the fourth switch transistor in the threshold compensation module to detect a threshold voltage; and if the gate of the fifth transistor in the anode resetting module is connected with the second scan line, then the fifth transistor is switched on to provide the fourth node with a signal of the initial signal end. In a data writing and light emission stage, the second transistor in the data writing module is switched on to provide the first node with a signal of the reference signal end; the third transistor in the light-emission control module is switched on to connect the third node with the fourth node; and the driver transistor in the driver control module is switched on to drive the organic light-emitting diode to emit light.

Advantageous effects of the disclosure are as follows:

In the display panel, the display device, and the method for driving a pixel circuit according to the embodiments of the disclosure, the pixel circuit includes: the data writing module, the light-emission control module, the driver control module, the threshold compensation module, the anode resetting module, the node initialization module, and the organic light-emitting diode, where the threshold compensation module can compensate for drifting of threshold voltage of the driver transistor so that the pixel circuit can emit light and display while the operating current of the driver transistor to drive the light-emitting element to emit light is only dependent upon a signal on the data line and the voltage at the reference signal end, but independent of the threshold voltage and the first power source voltage end to thereby avoid the threshold voltage and an IR drop from affecting the current flowing through the organic light-emitting diode. Moreover the anode resetting module can reset the potential at the anode of the organic light-emitting diode so that the organic light-emitting diode may not emit any light at all in a dark state. Furthermore the node initialization module can reset the gate of the driver transistor before the organic light-emitting diode emits light. Additionally the initial signal end and the reference signal end can be arranged separately to thereby alleviate the problems of crosstalk and non-uniform display in the circuit, and also create a larger range of data signals.

DETAILED DESCRIPTION OF THE EMBODIMENTS

Figure 1:
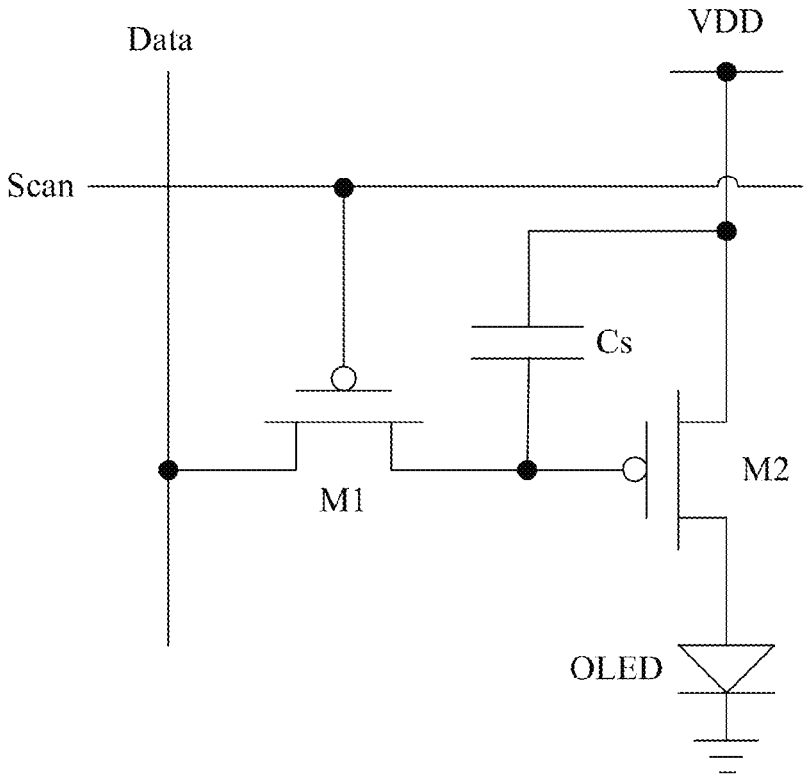
FIG. 1 is a schematic structural diagram of a traditional pixel circuit.

FIG. 1 illustrates an existing 2T1C pixel circuit including one driver transistor M2, one switch transistor M1, and one storage capacitor $C_S$, where when some row is selected by a scan line Scan, a low-level signal is input on the scan line Scan, the P-type switch transistor M1 is switched on, and voltage on a data line Data is written into the storage capacitor $C_S$; and at the end of scanning the row, the signal input on the scan line Scan is changed to a high level, the P-type switch transistor M1 is switched off, and the driver transistor M2 is switched on by gate voltage stored in the storage capacitor $C_S$ to produce current to drive an OLED so that the OLED is emitting light constantly for one frame. Here the equation of saturated current of the driver transistor M2 is $I_{OLED}=K(V_{SG}-V_{th})^2$. As described above, the threshold voltage $V_{th}$ of the driver transistor M2 may drift due to reasons such as a fabrication process thereof, and aging of elements thereof; and the current is dependent upon power source voltage VDD, so $V_S$ may vary due to an IR drop. As a consequence, the current flowing through the respective OLEDs may vary with the varying threshold voltage $V_{th}$ of the driver transistors, and source voltage VDD of the driver transistors, thus resulting in non-uniform brightness of an image.

In view of this, embodiments of the disclosure provide a display panel, a display device, and a method for driving a pixel circuit so as to address the problem in the prior art of non-uniform display.

In order to makes the objects, technical solutions, and advantages of the disclosure more apparent, the disclosure will be described below in further details with reference to the drawings, and apparently the embodiments to be described below are only a part but not all of the embodiments of the disclosure. Based upon the embodiments here of the disclosure, all the other embodiments which can occur to those ordinarily skilled in the art without any inventive effort shall fall into the scope of the disclosure as claimed.

The shapes and sizes of respective components in the drawings are not intended to reflect their real proportions, but only intended to illustrate the disclosure of the disclosure.

Figure 2:
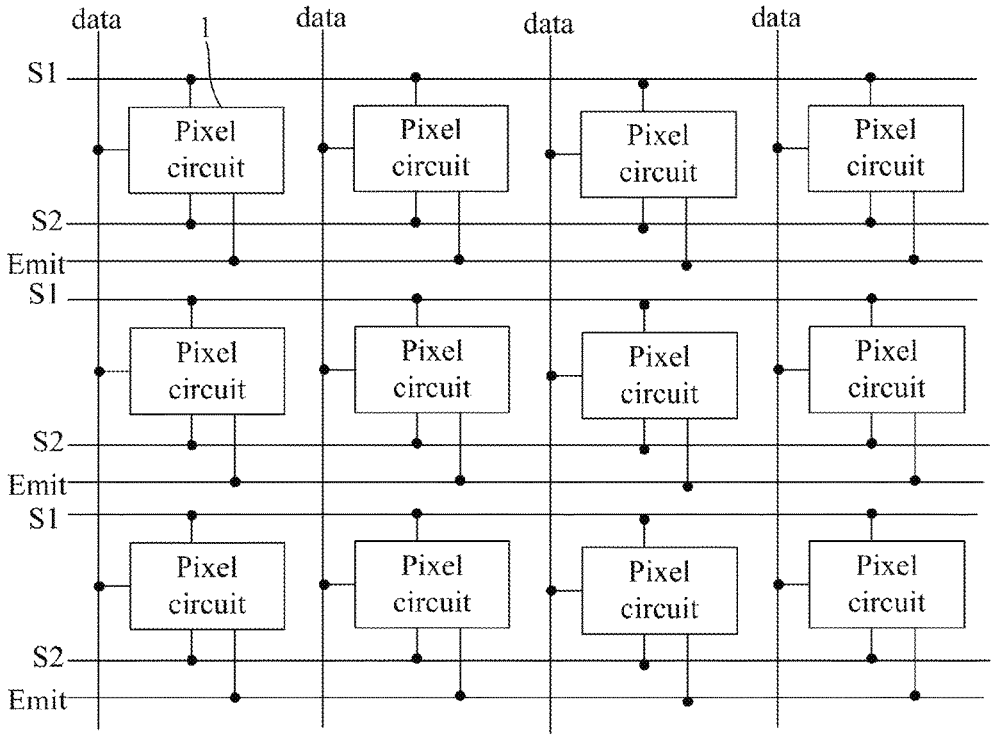
FIG. 2 is a schematic structural diagram of a display panel according to an embodiment of the disclosure.

A display panel according to an embodiment of the disclosure as illustrated in FIG. 2 includes: a plurality of pixel circuits 1 (a particular structure thereof is not illustrated in FIG. 1, but reference can be made to FIG. 3A to FIG. 5B therefore), and first scan lines S1, second scan lines S2, data lines Data, and light-emission control lines Emit, corresponding to the pixel circuits 1, where a pixel circuit 1 as illustrated in FIG. 3A to FIG. 5B includes: a data writing module 01, a light-emission control module 02, a driver control module 03, a threshold compensation module 04, an anode resetting module 05, a node initialization module 06, and an organic light-emitting diode oled.

Where the data writing module 01 includes a first transistor T1 and a second transistor T2, where the first transistor T1 has a gate connected with the second scan line S2, a first electrode connected with the data line Data, and a second electrode connected with a first node N1; and the second transistor T2 has a gate connected with the light-emission control line Emit, a first electrode connected with a reference signal end Vref, and a second electrode connected with the first node N1;

The light-emission control module 02 includes a third transistor T3, where the third transistor T3 has a gate connected with the light-emission control line Emit, a first electrode connected with a third node N3, and a second electrode connected with a fourth node N4;

The driver control module 03 includes a driver transistor T0, where the driver transistor T0 has a gate connected with a second node N2, a first electrode connected with a first power source voltage end Vdd, and a second electrode connected with the third node N3;

The threshold compensation module 04 includes a fourth transistor T4 and a capacitor C1, where the fourth transistor T4 has a gate connected with the second scan line S2, a first electrode connected with the second node n2, and a second electrode connected with the third node N3; and the capacitor C1 is connected between the first node N1 and the second node N2;

The anode resetting module 05 includes a fifth transistor T5, where the fifth transistor T5 has a gate connected with the first scan line S1 or the second scan line S2, a first electrode connected with an initial signal end Vint, and a second electrode connected with the fourth node N4;

The organic light-emitting diode oled is connected between the fourth node N4 and a second power source voltage end Vee; and The node initialization module 06 has a control end connected with the first scan line S1, an input end connected with the initial signal end Vint, and an output end connected between the third node N3 and the second node N2; and the node initialization module 06 is configured to be controlled by the control end thereof to provide the output end thereof with a signal received at the input end thereof.

In the display panel according to the embodiment of the disclosure, the pixel circuit includes: the data writing module, the light-emission control module, the driver control module, the threshold compensation module, the anode resetting module, the node initialization module, and the organic light-emitting diode, where the threshold compensation module can compensate for drifting of threshold voltage of the driver transistor so that the pixel circuit can emit light and display while operating current of the driver transistor to drive the light-emitting element to emit light is only dependent upon a signal on the data line, and the voltage at the reference signal end, but independent of the threshold voltage and the first power source voltage end, to thereby avoid the threshold voltage and an IR drop from affecting the current flowing through the organic light-emitting diode. Moreover the anode resetting module can reset the potential at the anode of the organic light-emitting diode so that the organic light-emitting diode may not emit any light at all in a dark state. Furthermore the node initialization module can reset the gate of the driver transistor before the organic light-emitting diode emits light. Additionally the initial signal end and the reference signal end can be arranged separately to thereby alleviate the problems of crosstalk and non-uniform display in the circuit, and also create a larger range of data signals.

In a particular implementation, in the display panel according to the embodiment of the disclosure, as illustrated in FIG. 3A to FIG. 5B, the node initialization module 06 includes a sixth transistor T6, where the sixth transistor T6 has a gate connected with the control end of the node initialization module 06, a first electrode connected with the input end of the node initialization module 06, and a second electrode connected with the output end of the node initialization module 06.

The particular structure of the node initialization module in the pixel circuit has been described above only as an example, and in a particular implementation, the particular structure of the node initialization module may not be limited to the structure above according to the embodiment of the disclosure, but may be another structure known to those skilled in the art without any limitation thereto.

In a particular implementation, in the display panel according to the embodiment of the disclosure, one of a first electrode and a second electrode of a transistor is a source electrode, and the other one is a drain electrode.

In a particular implementation, in the display panel according to the embodiment of the disclosure, the driver transistor is a P-type transistor, but the same design principle of the disclosure may apply to the driver transistor which is an N-type transistor without departing from the scope of the disclosure.

In a particular implementation, in the display panel according to the embodiment of the disclosure, all the transistors may be designed as P-type transistor to thereby simplify a process flow of fabricating the pixel circuit.

Figure 3A:
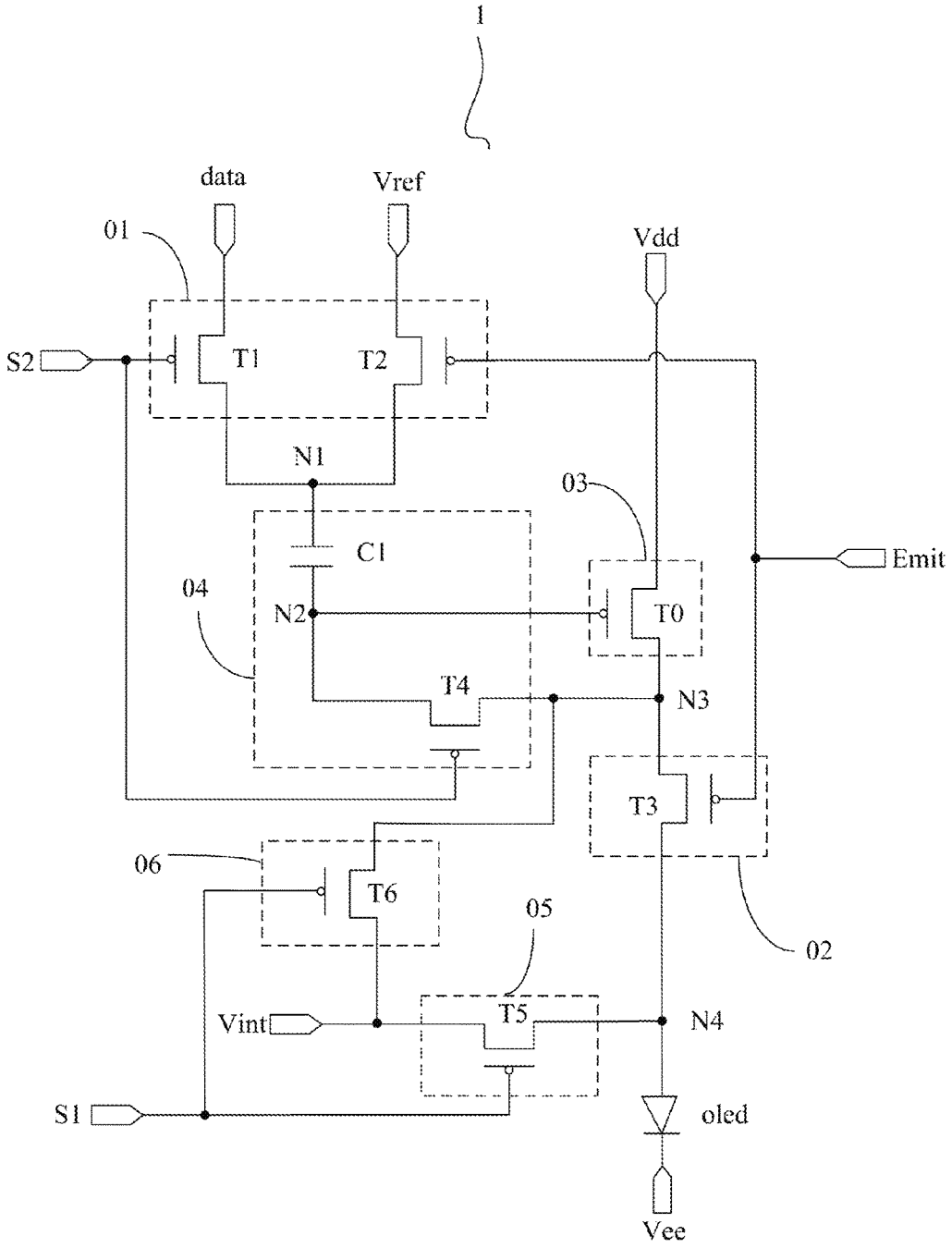
FIG. 3A is a schematic structural diagram of a pixel circuit in a display panel according to an embodiment of the disclosure.
Figure 3B:
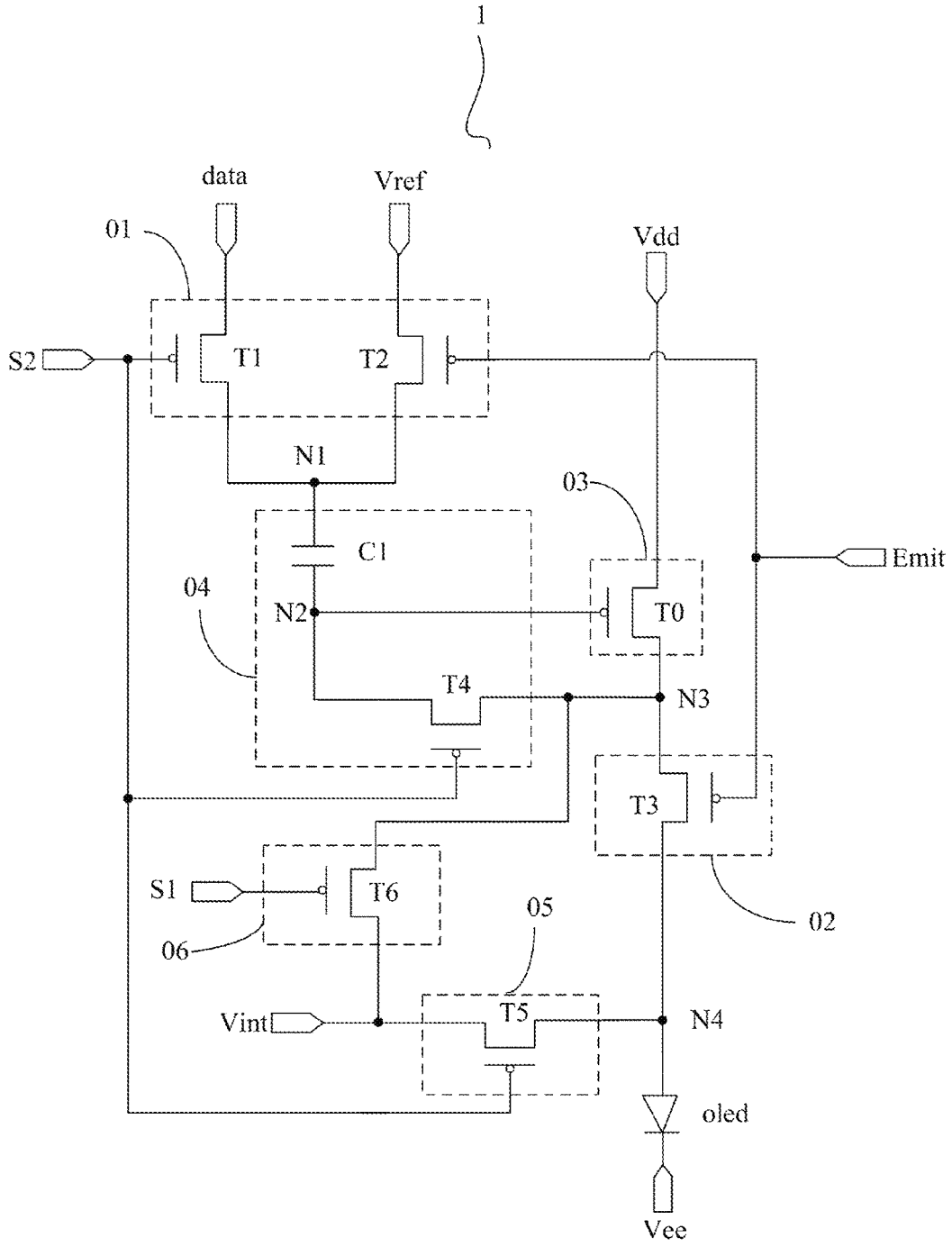
FIG. 3B is a schematic structural diagram of another pixel circuit in a display panel according to an embodiment of the disclosure.

In a particular implementation, in the display panel according to the embodiment of the disclosure, as illustrated in FIG. 3A and FIG. 3B, the output end of the node initialization module 06 can be connected with the third node N3, and the second electrode of the fourth transistor T4, so that leakage current at the second electrode of the driver transistor T0 can be split into three branches flowing to the fourth transistor T4, the third transistor T3, and the node initialization module 06 respectively, that is, the leakage current can be branched to thereby reduce the leakage current flowing to the third transistor T3 so as to reduce the leakage current flowing to the organic light-emitting diode oled.

Figure 4A:
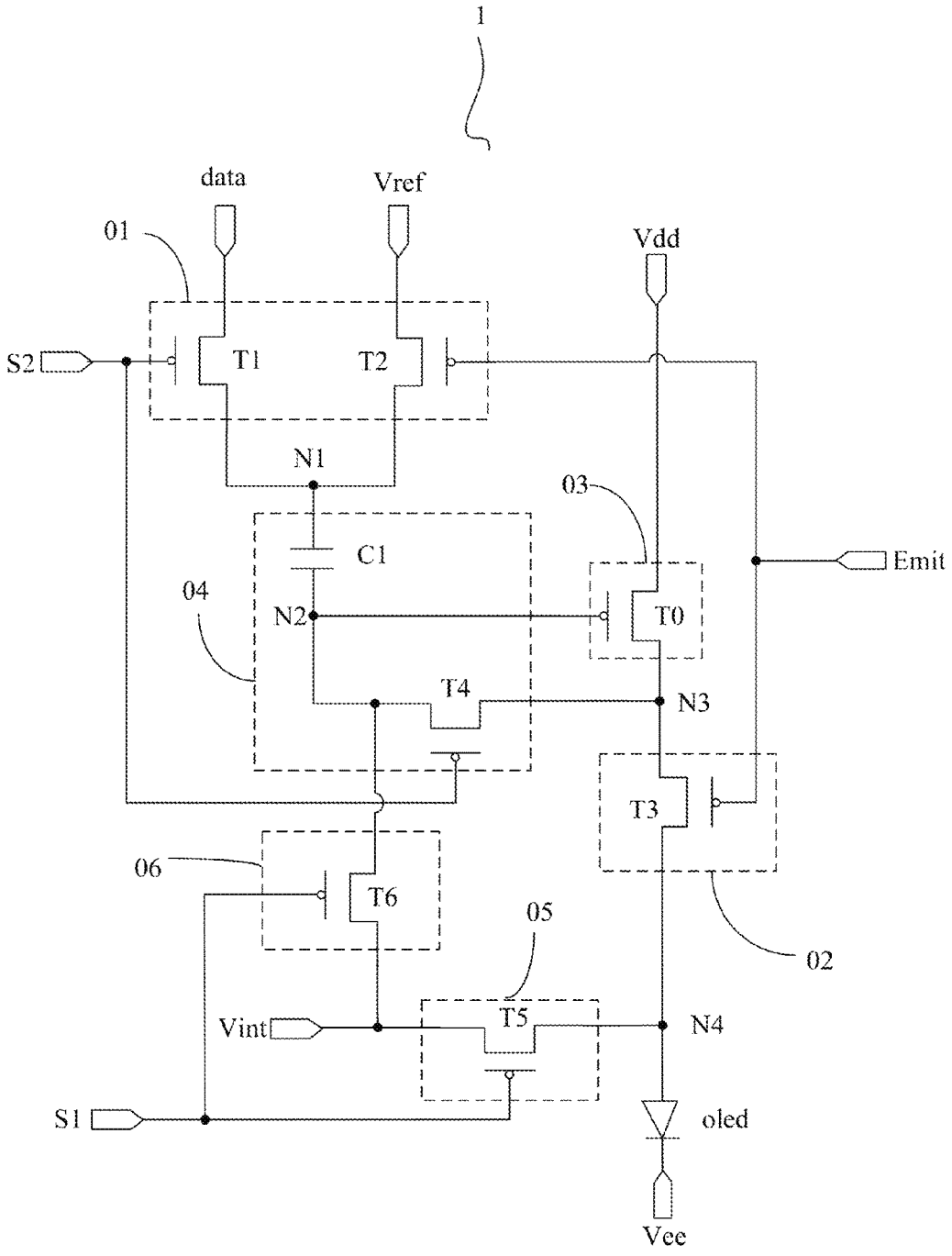
FIG. 4A is a schematic structural diagram of a further pixel circuit in a display panel according to an embodiment of the disclosure.
Figure 4B:
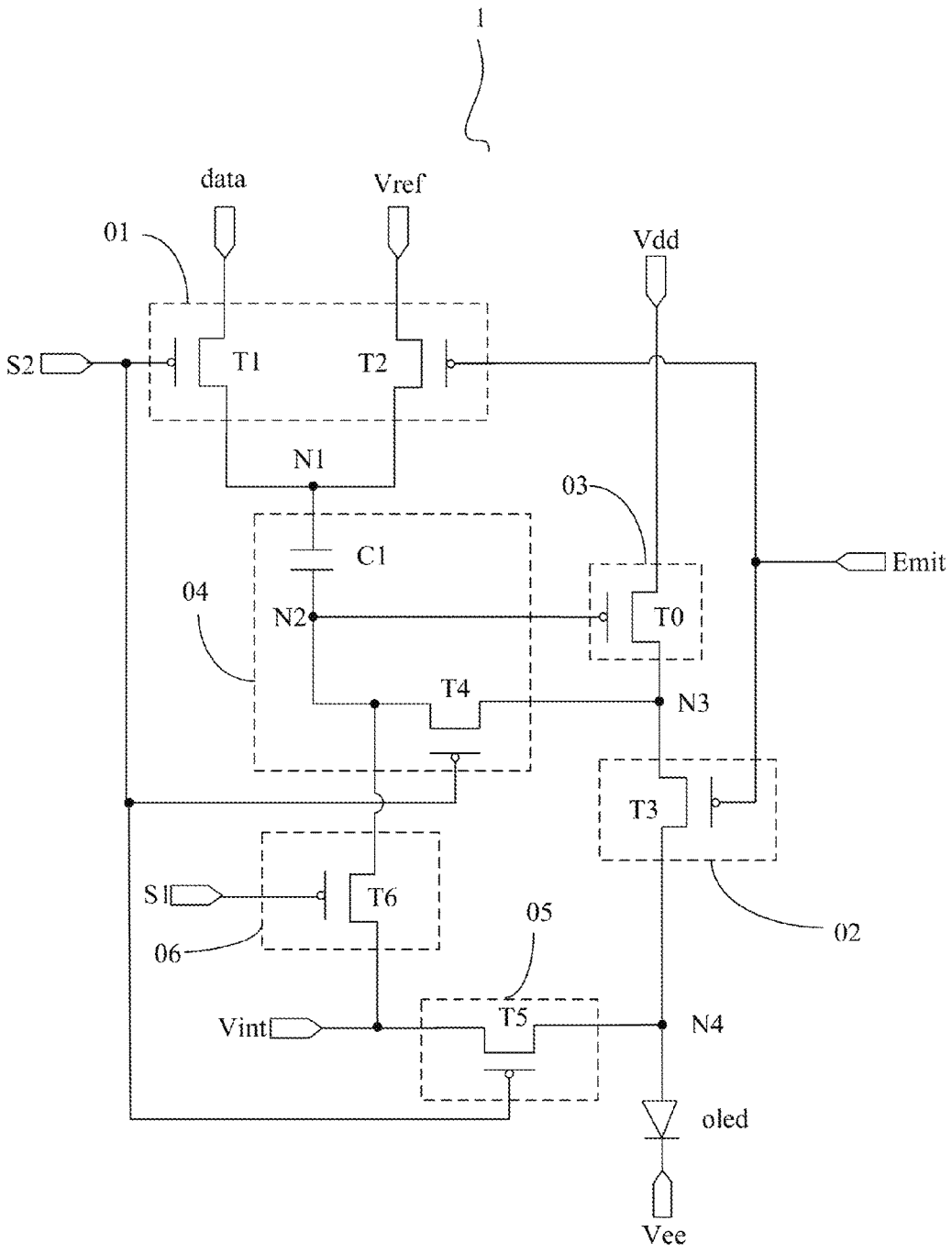
FIG. 4B is a schematic structural diagram of a further pixel circuit in a display panel according to an embodiment of the disclosure.

Alternatively in a particular implementation, in the display panel according to the embodiment of the disclosure, as illustrated in FIG. 4A and FIG. 4B, the output end of the node initialization module 06 is connected between the second node N2, and the first electrode of the fourth transistor T4, so that the node initialization module 06 can initialize the second node N2 directly without switching on the fourth transistor T4.

Figure 5A:
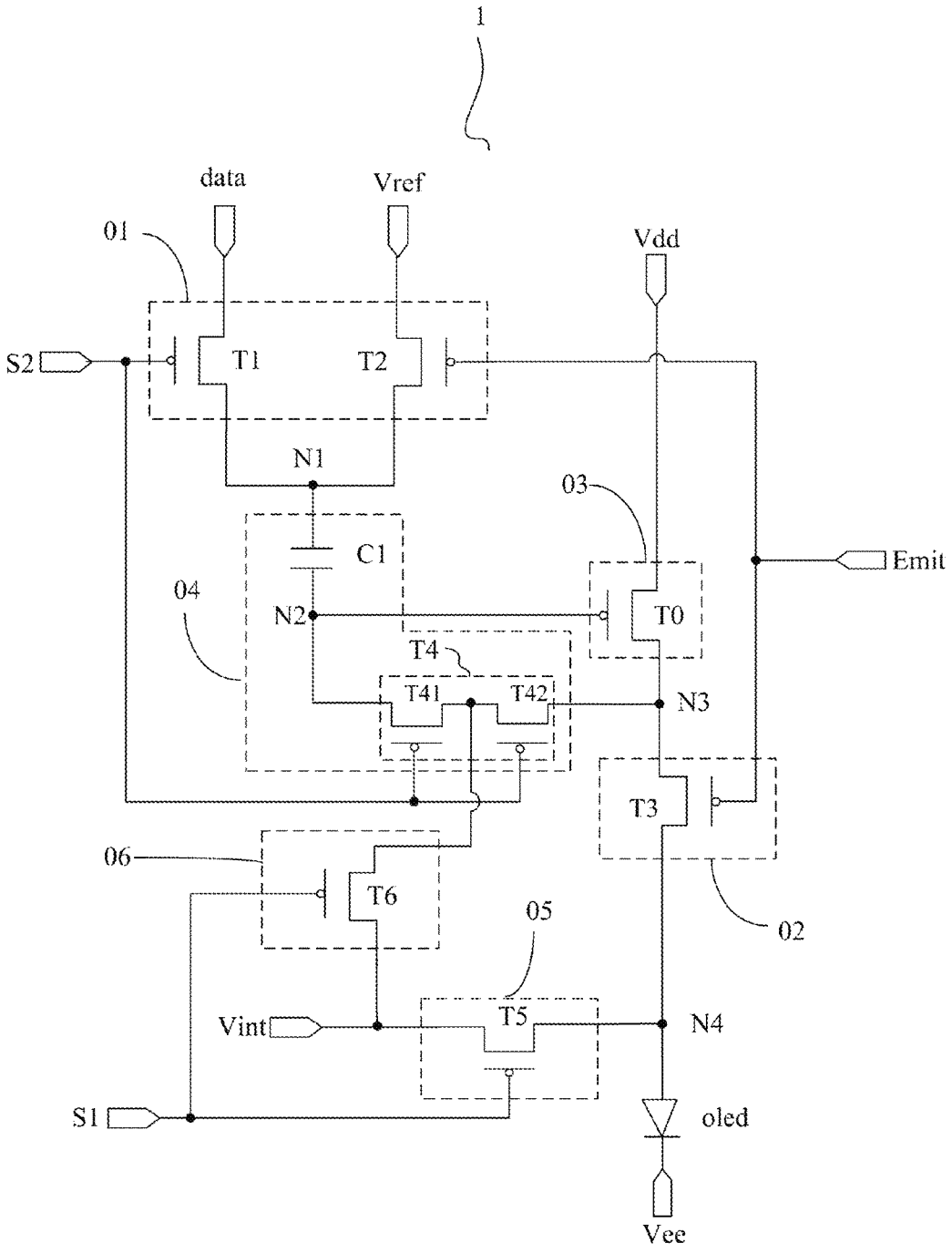
FIG. 5A is a schematic structural diagram of a further pixel circuit in a display panel according to an embodiment of the disclosure.
Figure 5B:
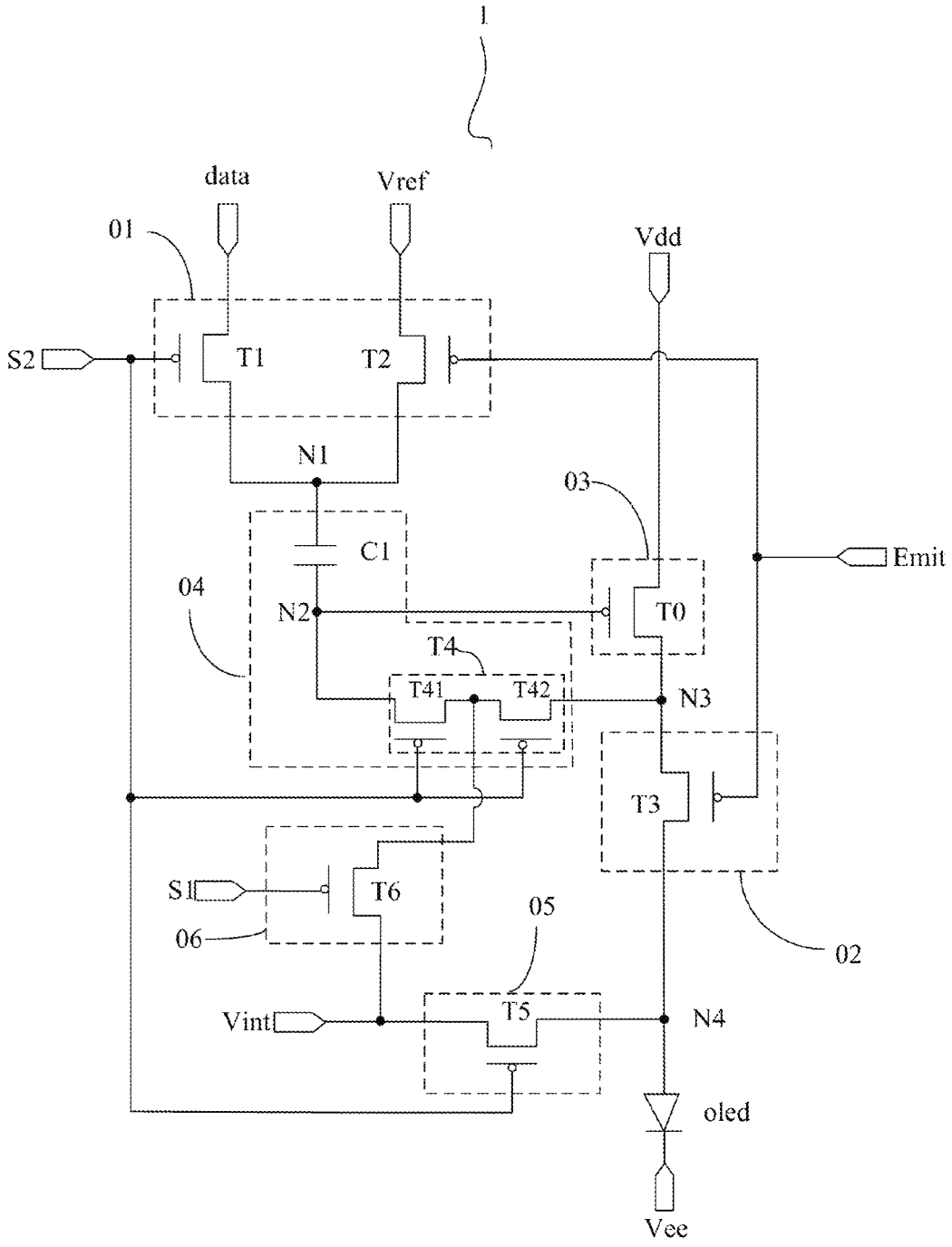
FIG. 5B is a schematic structural diagram of a further pixel circuit in a display panel according to an embodiment of the disclosure.

In a particular implementation, in the display panel according to the embodiment of the disclosure, as illustrated in FIG. 5A and FIG. 5B, the fourth transistor T4 is in a dual-gate structure including a first sub-transistor T41 and a second sub-transistor T42 connected in series. The output end of the node initialization module 06 is connected on a node where the first sub-transistor T41 and the second sub-transistor T42 are connected, so that the leakage current of the fourth transistor T4 can be reduced to thereby avoid the current of the capacitor C1 from being leaked through the fourth transistor T4 while the organic light-emitting diode oled is emitting light, which would otherwise result in brightness distortion of the organic light-emitting diode oled.

Of course, in a particular implementation, in the display panel according to the embodiment of the disclosure, the other transistors can also be arranged in a dual-gate structure without any limitation thereto.

An operating principle of the pixel circuit in the display panel according to the embodiment of the disclosure will be described below in details with reference to a timing diagram of the circuit, where 1 represents a high-level signal, and 0 represents a low-level signal in the following description.

In a first case, as illustrated in FIG. 3A, FIG. 4A, and FIG. 5A, the gate of the fifth transistor T5 is connected with the first scan line S1.

First Embodiment

Figure 6A:
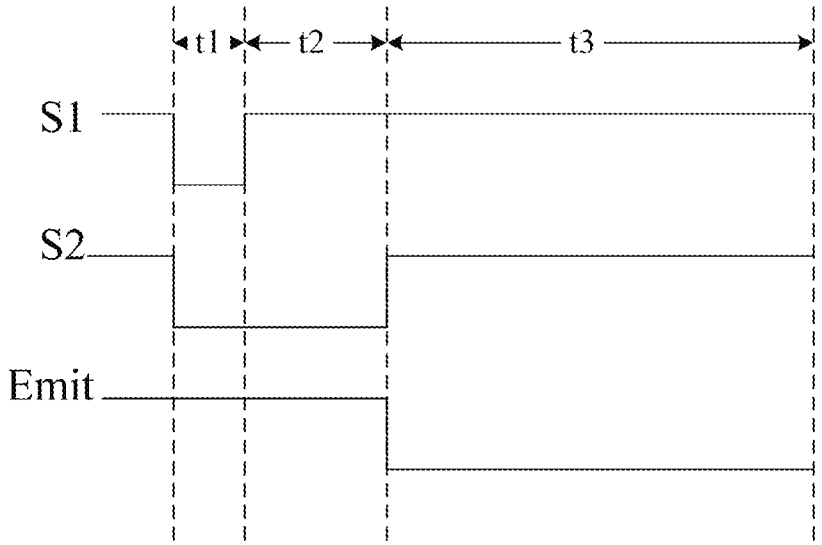
FIG. 6A is a timing diagram of a pixel circuit in a display panel according to an embodiment of the disclosure.

FIG. 6A illustrates a timing diagram of the pixel circuit as illustrated in FIG. 3A, FIG. 4A, and FIG. 5A, where there are three stages t1, t2, and t3.

In the t1 stage, S1=0, S2=0, and Emit=1.

The first transistor T1, the fourth transistor T4, the fifth transistor T5, the sixth transistor T6, and the driver transistor T0 are switched on, the second transistor T2 and the third transistor T3 are switched off, and the potential of the first node N1 is a potential Vdata on the data line Data, the potential of the second node N2 is Vint, the potential of the third node N3 is Vint, the potential of the fourth node N4 is Vint, and the organic light-emitting diode oled does not emit light. That is, the nodes are initialized, and the anode of the organic light-emitting diode oled is reset in the t1 stage.

In the t2 stage, S1=1, S2=0, and Emit=1.

The first transistor T1, the fourth transistor T4, and the driver transistor T0 are switched on, and the second transistor T2, the third transistor T3, the fifth transistor T5, and the sixth transistor T6 are switched off. The switched-on fourth transistor T4 makes the driver transistor T0 be structured as a diode. The potential of the first node N1 is Vdata, the potential of the second node N2 is Vdd−$|V_{th}|$, and the organic light-emitting diode oled does not emit light. That is, threshold detection is performed in the t2 stage.

In the t3 stage, S1=1, S2=1, and Emit=0.

The second transistor T2, the third transistor T3, and the driver transistor T0 are switched on, and the first transistor T1, the fourth transistor T4, the fifth transistor T5, and the sixth transistor T6 are switched off. The potential of the first node N1 is Vref, and as per the principle of conservation of the amount of charges in a capacitor, the potential of the second node N2 is Vdd−$|V_{th}|$+Vref−Vdata. The driver transistor T0 operates in a saturated state, and as per the characteristic of current in the saturated state, operating current $I_{oled}$ flowing through the driver transistor T0 to drive the organic light-emitting diode oled to emit light satisfies the equation of $I_{oled}=K(V_{sg}-|V_{th}|)^2=K\ [Vdd-(Vdd-|V_{th}|+Vref-Vdata)-|V_{th}|]^2=K(Vdata-Vref)^2$, where K represents a structural parameter, and the value thereof is relatively stable in the same structure, so it can be regarded as a constant. As can be apparent, the operating current $I_{oled}$ of the organic light-emitting diode oled is independent of the threshold voltage $V_{th}$ of the driver transistor T0 and the first power source voltage end Vdd, but only dependent upon the voltage Vdata on the data line Data and the voltage at the reference signal end Vref, thus alleviating the operating current $I_{oled}$ of the organic light-emitting diode oled from being affected by the threshold voltage $V_{11}$ and an IR drop in the driver transistor T0 so as to alleviate non-uniform display of the display panel.

Second Embodiment

Figure 6B:
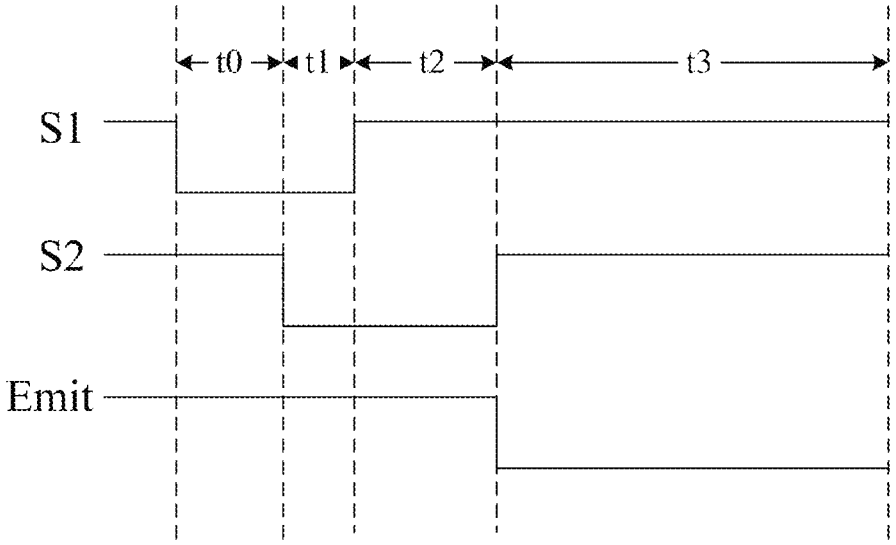
FIG. 6B is another timing diagram of a pixel circuit in a display panel according to an embodiment of the disclosure.

FIG. 6B illustrates a timing diagram of the pixel circuit as illustrated in FIG. 3A, FIG. 4A, and FIG. 5A, where there are four stages t0, t1, t2, and t3.

In the t0 stage, S1=0, S2=1, and Emit=1.

The fifth transistor T5 and the sixth transistor T6 are switched on, and the driver transistor T0, the first transistor T1, the second transistor T2, the third transistor T3, and the fourth transistor T4 are switched off. The potential of the fourth node N4 is Vint, the potential of the node connected with the second electrode of the sixth transistor T6 is Vint, and the organic light-emitting diode oled does not emit light. That is, the nodes are initialized, and the anode of the organic light-emitting diode oled is reset in the t0 stage.

In the t1 stage, S1=0, S2=0, and Emit=1.

The first transistor T1, the fourth transistor T4, the fifth transistor T5, the sixth transistor T6, and the driver transistor T0 are switched on, and the second transistor T2 and the third transistor T3 are switched off. The potential of the first node N1 is a potential Vdata on the data line Data, the potential of the second node N2 is Vint, the potential of the third node N3 is Vint, the potential of the fourth node N4 is Vint, and the organic light-emitting diode oled does not emit light. That is, the nodes are initialized, and the anode of the organic light-emitting diode oled is reset in the t1 stage.

In the t2 stage, S1=1, S2=0, and Emit=1.

The first transistor T1, the fourth transistor T4, and the driver transistor T0 are switched on, and the second transistor T2, the third transistor T3, the fifth transistor T5, and the sixth transistor T6 are switched off. The switched-on fourth transistor T4 makes the driver transistor T0 be structured as a diode. The potential of the first node N1 is Vdata, the potential of the second node N2 is Vdd−$|V_{th}|$, and the organic light-emitting diode oled does not emit light. That is, threshold detection is performed in the t2 stage.

In the t3 stage, S1=1, S2=1, and Emit=0.

The second transistor T2, the third transistor T3, and the driver transistor T0 are switched on, and the first transistor T1, the fourth transistor T4, the fifth transistor T5, and the sixth transistor T6 are switched off. The potential of the first node N1 is Vref, and as per the principle of conservation of the amount of charges in a capacitor, the potential of the second node N2 is Vdd-$|V_{th}|$+Vref−Vdata. The driver transistor T0 operates in a saturated state, and as per the characteristic of current in the saturated state, operating current $I_{oled}$ flowing through the driver transistor T0 to drive the organic light-emitting diode oled to emit light satisfies the equation of $I_{oled}=K(V_{sg}-|V_{th}|)^2=K\ [Vdd-(Vdd-|V_{th}|+Vref-Vdata)-|V_{th}|]^2=K(Vdata-Vref)^2$, where K represents a structural parameter, and the value thereof is relatively stable in the same structure, so it can be regarded as a constant. As can be apparent, the operating current $I_{oled}$ of the organic light-emitting diode oled is independent of the threshold voltage $V_{th}$ of the driver transistor T0 and the first power source voltage end Vdd, but only dependent upon the voltage Vdata on the data line Data and the voltage at the reference signal end Vref, thus alleviating the operating current $I_{oled}$ of the organic light-emitting diode oled from being affected by the threshold voltage $V_{th}$ and an IR drop in the driver transistor T0 so as to alleviate non-uniform display of the display panel.

In the second embodiment, the operating principle of the pixel circuit in the t1 to t3 stages is the same as the operating principle in the t1 to t3 stages in the first embodiment. However as can be apparent from the timing diagram illustrated in FIG. 6B, the signals on the first scan line and the second scan line are only different in their timing, so two adjacent rows of pixel circuits can be designed to share a scan line, that is, the first scan line corresponding to the n-th row of pixel circuits, and the second scan line corresponding to the (n−1)-th row of pixel circuits are the same scan line, where n is any integer more than 1 and less than or equal to N, and N is the total number of rows of pixel circuits, so that the amount of wiring to be arranged on the display panel can be reduced to thereby improve an aperture ratio.

Third Embodiment

FIG. 6A illustrates a timing diagram of the pixel circuit as illustrated in FIG. 3B, FIG. 4B, and FIG. 5B, where there are three stages t1, t2, and t3.

In the t1 stage, S1=0, S2=0, and Emit=1.

The first transistor T1, the fourth transistor T4, the fifth transistor T5, the sixth transistor T6, and the driver transistor T0 are switched on, and the second transistor T2 and the third transistor T3 are switched off. The potential of the first node N1 is a potential Vdata on the data line Data, the potential of the second node N2 is Vint, the potential of the third node N3 is Vint, the potential of the fourth node N4 is Vint, and the organic light-emitting diode oled does not emit light. That is, the nodes are initialized, and the anode of the organic light-emitting diode oled is reset in the t1 stage.

In the t2 stage, S1=1, S2=0, and Emit=1.

The first transistor T1, the fourth transistor T4, the fifth transistor T5, and the driver transistor T0 are switched on, and the second transistor T2, the third transistor T3, and the sixth transistor T6 are switched off. The switched-on fourth transistor T4 makes the driver transistor T0 be structured as a diode. The potential of the first node N1 is Vdata, the potential of the fourth node N4 is Vint, the potential of the second node N2 is Vdd−$|V_{th}|$, and the organic light-emitting diode oled does not emit light. That is, threshold detection is performed, and the anode of the organic light-emitting diode oled is reset in the t2 stage.

In the t3 stage, S1=1, S2=1, and Emit=0.

The second transistor T2, the third transistor T3, and the driver transistor T0 are switched on, and the first transistor T1, the fourth transistor T4, the fifth transistor T5, and the sixth transistor T6 are switched off. The potential of the first node N1 is Vref, and as per the principle of conservation of the amount of charges in a capacitor, the potential of the second node N2 is Vdd−$|V_{th}|$+Vref−Vdata. The driver transistor T0 operates in a saturated state, and as per the characteristic of current in the saturated state, operating current $I_{oled}$ flowing through the driver transistor T0 to drive the organic light-emitting diode oled to emit light satisfies the equation of $I_{oled}=K(V_{sg}-|V_{th}|)^2=K\ [Vdd-(Vdd-|V_{th}|+Vref-Vdata)-|V_{th}|]^2=K(Vdata-Vref)^2$, where K represents a structural parameter, and the value thereof is relatively stable in the same structure, so it can be regarded as a constant. As can be apparent, the operating current $I_{oled}$ of the organic light-emitting diode oled is independent of the threshold voltage $V_{th}$ of the driver transistor T0 and the first power source voltage end Vdd, but only dependent upon the voltage Vdata on the data line Data and the voltage at the reference signal end Vref, thus alleviating the operating current $I_{oled}$ of the organic light-emitting diode oled from being affected by the threshold voltage $V_{th}$ and an IR drop in the driver transistor T0 so as to alleviate non-uniform display of the display panel.

Fourth Embodiment

FIG. 6B illustrates a timing diagram of the pixel circuit as illustrated in FIG. 3B, FIG. 4B, and FIG. 5B, where there are four stages t0, t1, t2, and t3.

In the t0 stage, S1=0, S2=1, and Emit=1.

The sixth transistor T6 is switched on, and the driver transistor T0, the first transistor T1, the second transistor T2, the third transistor T3, the fourth transistor T4, and the fifth transistor T5 are switched off. The potential of the node connected with the second electrode of the sixth transistor T6 is Vint, and the organic light-emitting diode oled does not emit light. That is, the nodes are initialized in the t0 stage.

In the t1 stage, S1=0, S2=0, and Emit=1.

The first transistor T1, the fourth transistor T4, the fifth transistor T5, the sixth transistor T6, and the driver transistor T0 are switched on, and the second transistor T2 and the third transistor T3 are switched off. The potential of the first node N1 is a potential Vdata on the data line Data, the potential of the second node N2 is Vint, the potential of the third node N3 is Vint, the potential of the fourth node N4 is Vint, and the organic light-emitting diode oled does not emit light. That is, the nodes are initialized, and the anode of the organic light-emitting diode oled is reset in the t1 stage.

In the t2 stage, S1=1, S2=0, and Emit=1.

The first transistor T1, the fourth transistor T4, the fifth transistor T5, and the driver transistor T0 are switched on, and the second transistor T2, the third transistor T3, and the sixth transistor T6 are switched off. The switched-on fourth transistor T4 makes the driver transistor T0 be structured as a diode. The potential of the first node N1 is Vdata, the potential of the fourth node N4 is Vint, the potential of the second node N2 is Vdd−$|V_{th}|$, and the organic light-emitting diode oled does not emit light. That is, threshold detection is performed, and the anode of the organic light-emitting diode oled is reset in the t2 stage.

In the t3 stage, S1=1, S2=1, and Emit=0.

The second transistor T2, the third transistor T3, and the driver transistor T0 are switched on, and the first transistor T1, the fourth transistor T4, the fifth transistor T5, and the sixth transistor T6 are switched off. The potential of the first node N1 is Vref, and as per the principle of conservation of the amount of charges in a capacitor, the potential of the second node N2 is Vdd−$|V_{th}|$+Vref−Vdata. The driver transistor T0 operates in a saturated state, and as per the characteristic of current in the saturated state, operating current $I_{oled}$ flowing through the driver transistor T0 to drive the organic light-emitting diode oled to emit light satisfies the equation of $I_{oled}=K(V_{sg}-|V_{th}|)^2=K\ [Vdd-(Vdd-|V_{th}|+Vref-Vdata)-|V_{th}|]^2=K(Vdata-Vref)$, where K represents a structural parameter, and the value thereof is relatively stable in the same structure, so it can be regarded as a constant. As can be apparent, the operating current $I_{oled}$ of the organic light-emitting diode oled is independent of the threshold voltage $V_{th}$ of the driver transistor T0 and the first power source voltage end Vdd, but only dependent upon the voltage Vdata on the data line Data and the voltage at the reference signal end Vref, thus alleviating the operating current $I_{oled}$ of the organic light-emitting diode oled from being affected by the threshold voltage $V_{th}$ and an IR drop in the driver transistor T0 so as to alleviate non-uniform display of the display panel.

In the fourth embodiment, the operating principle of the pixel circuit in the t1 to t3 stages is the same as the operating principle in the t1 to t3 stages in the third embodiment. However as can be apparent from the timing diagram illustrated in FIG. 6B, the signals on the first scan line and the second scan line are only different in their timing, so two adjacent rows of pixel circuits can be designed to share a scan line, that is, the first scan line corresponding to the n-th row of pixel circuits, and the second scan line corresponding to the (n−1)-th row of pixel circuits are the same scan line, where n is any integer more than 1 and less than or equal to N, and N is the total number of rows of pixel circuits, so that the amount of wiring to be arranged on the display panel can be reduced to thereby improve an aperture ratio.

In the display panel above according to the embodiment of the disclosure, in order to enable the anode resetting module 05, i.e., the fifth transistor T5, to be switched off in the t3 stage, possibly the second scan line S2 is changed to a high potential before the light-emission control line Emit is changed to a low potential.

In a particular implementation, in the display panel above according to the embodiment of the disclosure, in order to enable the anode to be reset, and to enable the driver transistor to be switched on in the light-emission stage, the voltage of the initial signal end is generally negative voltage.

In a particular implementation, in the display panel above according to the embodiment of the disclosure, the potential of the second node N2 is Vdd−$|V_{th}|$+Vref−Vdata in the t3 stage, and in order to enable the driver transistor T0 to be switched on, Vref−Vdata shall be less than 0, that is, Vref<Vdata; and in order to set the voltage on the data line to positive voltage, the voltage of the reference signal end is generally positive voltage.

As can be apparent from the embodiment above, in the display panel above according to the embodiment of the disclosure, since the reference signal end and the initial signal end are different ends, the voltage of the reference signal end may be set without taking into account whether the anode can be reset, and thus can be adjusted in a larger range. Since the voltage of the reference signal end can be adjusted in a larger range, the voltage of the data signal on the data line can also be adjusted in a larger range. Moreover, as compared with the reference signal end and the initial signal end being arranged as the same end, if the reference signal end and the initial signal end are arranged as different ends, then the problems of crosstalk and non-uniform display may be further alleviated, because if the reference signal end and the initial signal end are arranged as the same end, then if the n-th row of pixel circuits is operating in the light-emission stage, then the potential at the first node N1 may be controlled by the reference signal end Vref, but the anodes of the pixel circuits in the rows succeeding to the n-th row may need to be reset, so that Vref on the display panel needs to be provided to both the n-th row of pixel circuits, and the other pixel circuits with their anodes to be reset, where there may be such a high resistance to be passed through by Vref that Vref arriving at the n-th row of pixel circuits may not be stable, which can be avoided if the reference signal end and the initial signal end are arranged as different ends.

Figure 7:
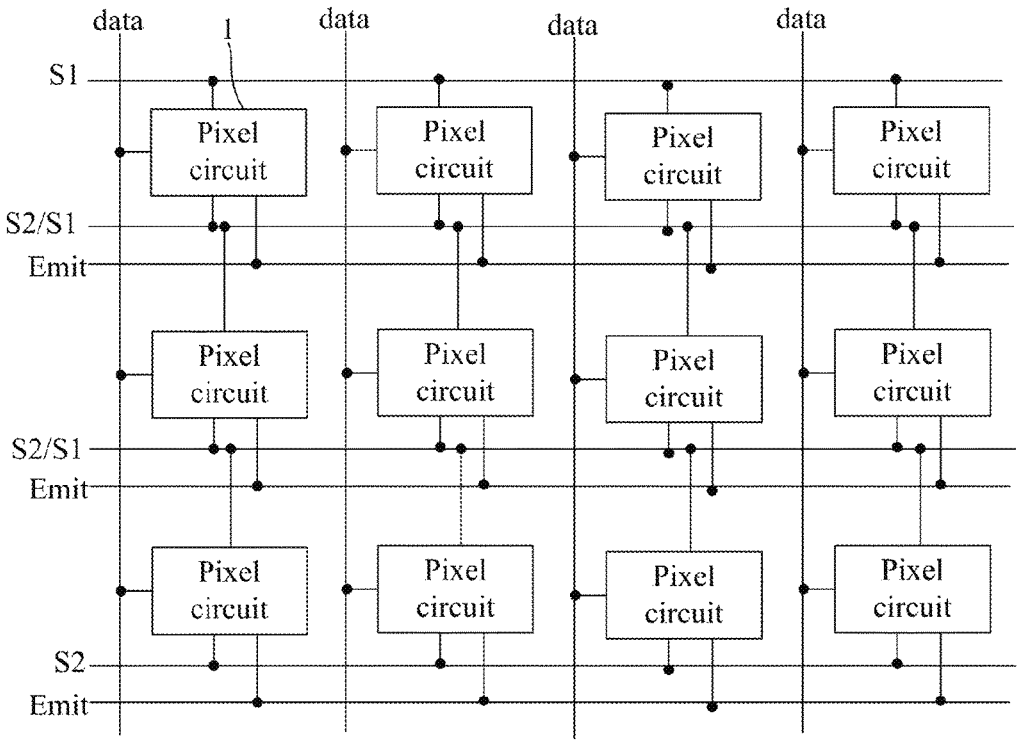
FIG. 7 is another schematic structural diagram of a display panel according to an embodiment of the disclosure.

In a particular implementation, in the display panel above according to the embodiment of the disclosure, as illustrated in FIG. 7, the first scan line S1 corresponding to the n-th row of pixel circuits 1, and the second scan line S2 corresponding to the (n−1)-th row of pixel circuits 1 are the same scan line (S2/S1), where n is any integer more than 1 and less than or equal to N, and N is the total number of rows of pixel circuits, so that the amount of wiring to be arranged on the display panel can be reduced to thereby improve an aperture ratio. Moreover the timing applied to the pixel circuits in the display panel is the timing as illustrated in FIG. 6B. Since all of the scan lines on the display panel are scanned sequentially in timing, all of the first scan lines and the second scan lines can be further controlled using the same driver circuit.

Figure 9:
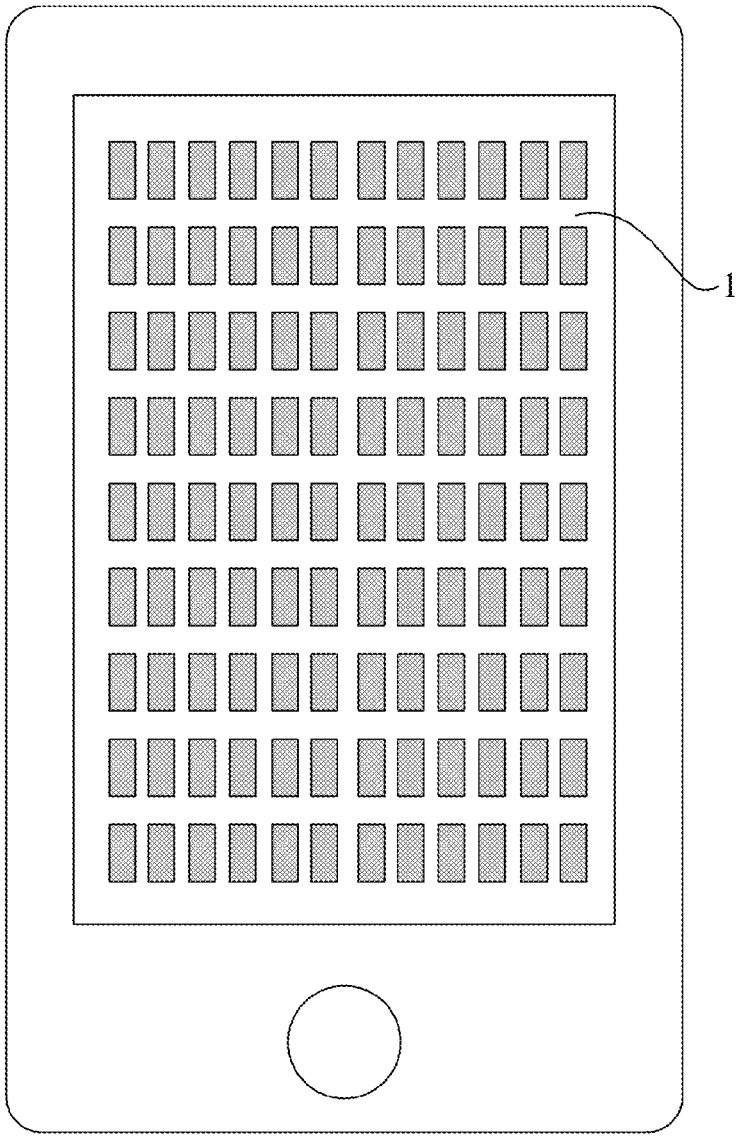
FIG. 9 is a schematic structural diagram of a display device according to an embodiment of the disclosure.

Based upon the same inventive idea, an embodiment of the disclosure further provides a display device as illustrated in FIG. 9, where the display device includes the display panel 1 according to any one of the embodiments above of the disclosure. The display device can be any product or component capable of displaying, such as a mobile phone, a tablet computer, a TV set, a display, a notebook computer, a digital photo frame, or a navigator. Since the display device addresses the problem under a similar principle to the display panel above, reference can be made to the embodiments of the display panel above for an implementation of the display device, so a repeated description thereof will be omitted here.

Figure 8A:
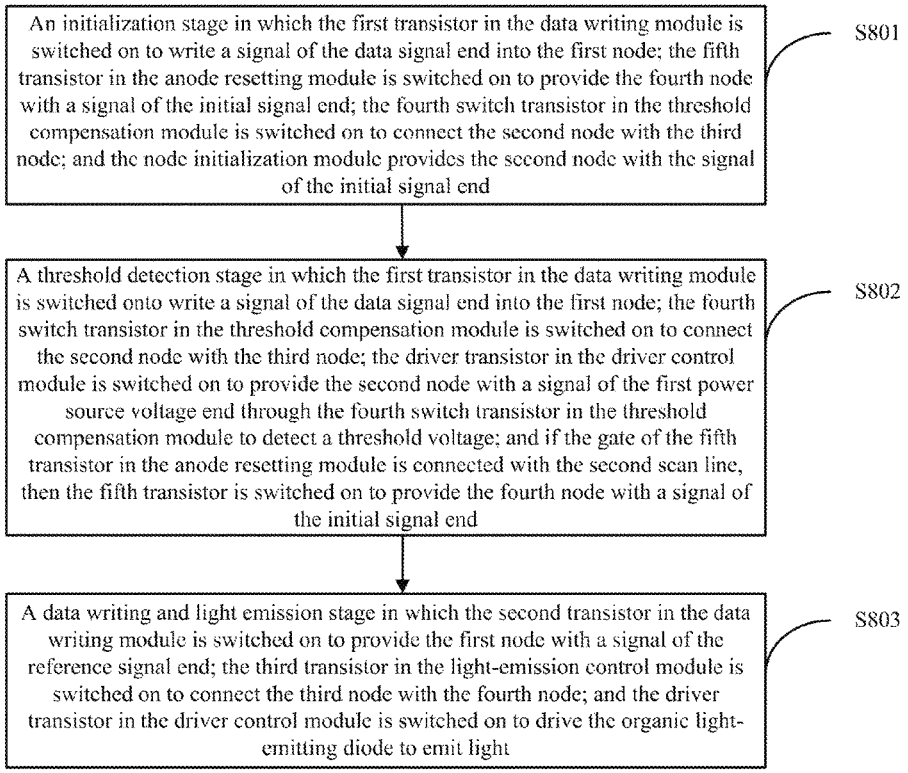
FIG. 8A is a schematic flow chart of a method for driving a pixel circuit according to an embodiment of the disclosure.

Based upon the same inventive idea, an embodiment of the disclosure further provides a method for driving a pixel circuit, which is applicable to driving of the pixel circuits in the display panel above according to the embodiments of the disclosure, and as illustrated in FIG. 8A, the driving method includes the following steps.

The step S801 is to perform an initialization stage in which the first transistor in the data writing module is switched on to write a signal of the data signal end into the first node; the fifth transistor in the anode resetting module is switched on to provide the fourth node with a signal of the initial signal end; the fourth switch transistor in the threshold compensation module is switched on to connect the second node with the third node; and the node initialization module provides the second node with the signal of the initial signal end;

The step S802 is to perform a threshold detection stage in which the first transistor in the data writing module is switched onto write a signal of the data signal end into the first node; the fourth switch transistor in the threshold compensation module is switched on to connect the second node with the third node; the driver transistor in the driver control module is switched on to provide the second node with a signal of the first power source voltage end through the fourth switch transistor in the threshold compensation module to detect a threshold voltage; and if the gate of the fifth transistor in the anode resetting module is connected with the second scan line, then the fifth transistor is switched on to provide the fourth node with a signal of the initial signal end; and The step S803 is to perform a data writing and light emission stage in which the second transistor in the data writing module is switched on to provide the first node with a signal of the reference signal end; the third transistor in the light-emission control module is switched on to connect the third node with the fourth node; and the driver transistor in the driver control module is switched on to drive the organic light-emitting diode to emit light.

In a particular implementation, reference can be made to FIG. 6A for the timing in the driving method according to the embodiment of the disclosure as illustrated in FIG. 8A, and reference can be made to the first embodiment and the third embodiment above for a particular operating principle thereof, so a repeated description thereof will be omitted here.

Figure 8B:
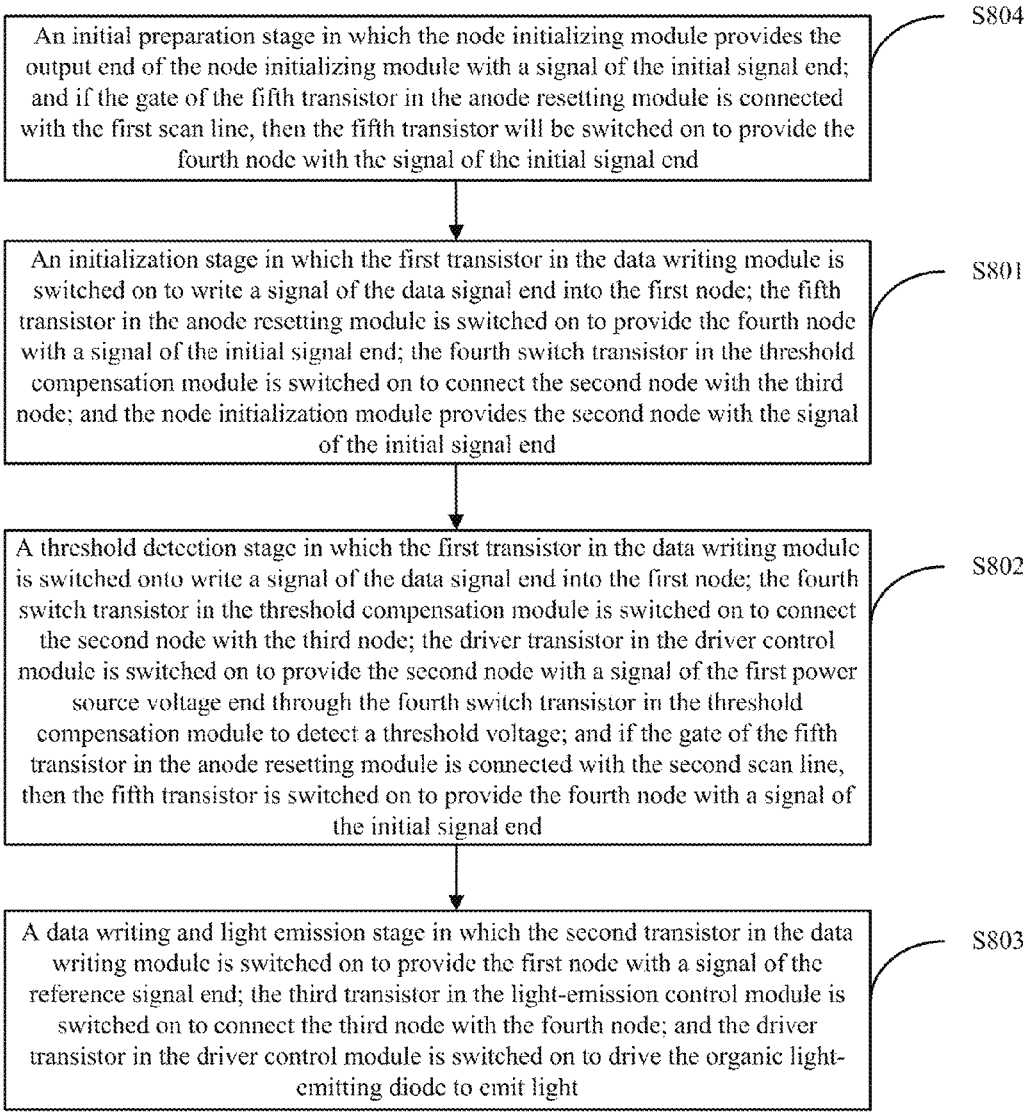
FIG. 8B is a schematic flow chart of another method for driving a pixel circuit according to an embodiment of the disclosure.

Furthermore in the driving method above according to the embodiment of the disclosure, as illustrated in FIG. 8B, before the initialization stage is performed in the step S801, the driving method further includes:

The step S804 is to perform an initial preparation stage in which the node initializing module provides the output end of the node initializing module with a signal of the initial signal end; and if the gate of the fifth transistor in the anode resetting module is connected with the first scan line, then the fifth transistor is switched on to provide the fourth node with the signal of the initial signal end.

In a particular implementation, reference can be made to FIG. 6B for the timing in the driving method according to the embodiment of the disclosure as illustrated in FIG. 8B, and reference can be made to the second embodiment and the fourth embodiment above for a particular operating principle thereof, so a repeated description thereof will be omitted here.

In the display panel, the display device, and the method for driving a pixel circuit according to the embodiments of the disclosure, the pixel circuit includes: the data writing module, the light-emission control module, the driver control module, the threshold compensation module, the anode resetting module, the node initialization module, and the organic light-emitting diode, where the threshold compensation module can compensate for drifting of threshold voltage of the driver transistor so that the pixel circuit can emit light and display while the operating current of the driver transistor to drive the light-emitting element to emit light is only dependent upon a signal on the data line and the voltage at the reference signal end, but independent of the threshold voltage and the first power source voltage end to thereby avoid the threshold voltage and an IR drop from affecting the current flowing through the organic light-emitting diode. Moreover the anode resetting module can reset the potential at the anode of the organic light-emitting diode so that the organic light-emitting diode may not emit any light at all in a dark state. Furthermore the node initialization module can reset the gate of the driver transistor before the organic light-emitting diode emits light. Additionally the initial signal end and the reference signal end can be arranged separately to thereby alleviate the problems of crosstalk and non-uniform display in the circuit, and also create a larger range of data signals.

Evidently those skilled in the art can make various modifications and variations to the disclosure without departing from the spirit and scope of the disclosure. Accordingly the disclosure is also intended to encompass these modifications and variations thereto so long as the modifications and variations come into the scope of the claims appended to the disclosure and their equivalents.

The invention claimed is:

1. A display panel, comprising:

a plurality of pixel circuits, and first scan lines, second scan lines, data lines, and light-emission control lines, corresponding to the pixel circuits, wherein each of the pixel circuits comprises:

a data writing module, a light-emission control module, a driver control module, a threshold compensation module, an anode resetting module, a node initialization module, and an organic light-emitting diode, wherein:

the data writing module comprises a first transistor and a second transistor, wherein the first transistor has a gate connected with the second scan line, a first electrode connected with the data line, and a second electrode connected with a first node; and the second transistor has a gate connected with the light-emission control line, a first electrode connected with a reference signal end, and a second electrode connected with the first node;

the light-emission control module comprises a third transistor, wherein the third transistor has a gate connected with the light-emission control line, a first electrode connected with a third node, and a second electrode connected with a fourth node;

the driver control module comprises a driver transistor, wherein the driver transistor has a gate connected with a second node, a first electrode connected with a first power source voltage end, and a second electrode connected with the third node;

the threshold compensation module comprises a fourth transistor and a capacitor, wherein the fourth transistor has a gate connected with the second scan line, a first electrode connected with the second node, and a second electrode connected with the third node; and the capacitor is connected between the first node and the second node;

the anode resetting module comprises a fifth transistor, wherein the fifth transistor has a gate connected with the first scan line or the second scan line, a first electrode connected with an initial signal end and a second electrode connected with the fourth node;

the organic light-emitting diode is connected between the fourth node and a second power source voltage end; and the node initialization module has a control end connected with the first scan line, an input end connected with the initial signal end, and an output end connected between the third node and the second node; and the node initialization module is configured to be controlled by the control end thereof to provide the output end thereof with a signal received at the input end thereof;

wherein the voltage of the reference signal end is positive voltage, and the voltage of the initial signal end is negative voltage.

2. The display panel according to claim 1, wherein the fourth transistor is in a dual-gate structure comprising a first sub-transistor and a second sub-transistor connected in series.

3. The display panel according to claim 2, wherein the output end of the node initialization module is connected with a node where the first sub-transistor and the second sub-transistor are connected.

4. The display panel according to claim 1, wherein the node initialization module comprises a sixth transistor; and the sixth transistor has a gate connected with the control end of the node initialization module, a first electrode connected with the input end of the node initialization module, and a second electrode connected with the output end of the node initialization module.

5. The display panel according to claim 1, wherein the output end of the node initialization module is connected between the third node, and the second electrode of the fourth transistor.

6. The display panel according to claim 1, wherein the output end of the node initialization module is connected between the second node, and the first electrode of the fourth transistor.

7. The display panel according to claim 1, wherein all the transistors in the pixel circuit are P-type transistors.

8. The display panel according to claim 1, wherein the first scan line corresponding to the n-th row of pixel circuits, and the second line corresponding to the (n−1)-th row of pixel circuits are the same scan line, wherein n is any integer more than 1 and less than or equal to N, and N is the total number of rows of pixel circuits.

9. A display device, comprising a display panel, wherein the display panel comprises a plurality of pixel circuits, and first scan lines, second scan lines, data lines, and light-emission control lines, corresponding to the pixel circuits, wherein each of the pixel circuits comprises: a data writing module, a light-emission control module, a driver control module, a threshold compensation module, an anode resetting module, a node initialization module, and an organic light-emitting diode, wherein:

the data writing module comprises a first transistor and a second transistor, wherein the first transistor has a gate connected with the second scan line, a first electrode connected with the data line, and a second electrode connected with a first node; and the second transistor has a gate connected with the light-emission control line, a first electrode connected with a reference signal end, and a second electrode connected with the first node;

the light-emission control module comprises a third transistor, wherein the third transistor has a gate connected with the light-emission control line, a first electrode connected with a third node, and a second electrode connected with a fourth node;

the driver control module comprises a driver transistor, wherein the driver transistor has a gate connected with a second node, a first electrode connected with a first power source voltage end, and a second electrode connected with the third node;

the threshold compensation module comprises a fourth transistor and a capacitor, wherein the fourth transistor has a gate connected with the second scan line, a first electrode connected with the second node, and a second electrode connected with the third node; and the capacitor is connected between the first node and the second node;

the anode resetting module comprises a fifth transistor, wherein the fifth transistor has a gate connected with the first scan line or the second scan line, a first electrode connected with an initial signal end and a second electrode connected with the fourth node;

the organic light-emitting diode is connected between the fourth node and a second power source voltage end; and the node initialization module has a control end connected with the first scan line, an input end connected with the initial signal end, and an output end connected between the third node and the second node; and the node initialization module is configured to be controlled by the control end thereof to provide the output end thereof with a signal received at the input end thereof;

wherein the voltage of the reference signal end is positive voltage, and the voltage of the initial signal end is negative voltage.

10. The display device according to claim 9, wherein the fourth transistor is in a dual-gate structure comprising a first sub-transistor and a second sub-transistor connected in series.

11. The display device according to claim 10, wherein the output end of the node initialization module is connected with a node where the first sub-transistor and the second sub-transistor are connected.

12. The display device according to claim 9, wherein the node initialization module comprises a sixth transistor; and the sixth transistor has a gate connected with the control end of the node initialization module, a first electrode connected with the input end of the node initialization module, and a second electrode connected with the output end of the node initialization module.

13. The display device according to claim 9, wherein the output end of the node initialization module is connected between the third node, and the second electrode of the fourth transistor.

14. The display device according to claim 9, wherein the output end of the node initialization module is connected between the second node, and the first electrode of the fourth transistor.

15. The display device according to claim 9, wherein all the transistors in the pixel circuit are P-type transistors.

16. The display device according to claim 9, wherein the first scan line corresponding to the n-th row of pixel circuits, and the second line corresponding to the (n−1)-th row of pixel circuits are the same scan line, wherein n is any integer more than 1 and less than or equal to N, and N is the total number of rows of pixel circuits.

17. A method for driving a pixel circuit, applicable to driving of pixel circuits in a display panel, wherein the display panel comprises a plurality of pixel circuits, and first scan lines, second scan lines, data lines, and light-emission control lines, corresponding to the pixel circuits, wherein each of the pixel circuits comprises: a data writing module, a light-emission control module, a driver control module, a threshold compensation module, an anode resetting module, a node initialization module, and an organic light-emitting diode, wherein:

the data writing module comprises a first transistor and a second transistor, wherein the first transistor has a gate connected with the second scan line, a first electrode connected with the data line, and a second electrode connected with a first node; and the second transistor has a gate connected with the light-emission control line, a first electrode connected with a reference signal end, and a second electrode connected with the first node;

the light-emission control module comprises a third transistor, wherein the third transistor has a gate connected with the light-emission control line, a first electrode connected with a third node, and a second electrode connected with a fourth node;

the driver control module comprises a driver transistor, wherein the driver transistor has a gate connected with a second node, a first electrode connected with a first power source voltage end, and a second electrode connected with the third node;

the threshold compensation module comprises a fourth transistor and a capacitor, wherein the fourth transistor has a gate connected with the second scan line, a first electrode connected with the second node, and a second electrode connected with the third node; and the capacitor is connected between the first node and the second node;

the anode resetting module comprises a fifth transistor, wherein the fifth transistor has a gate connected with the first scan line or the second scan line, a first electrode connected with an initial signal end and a second electrode connected with the fourth node;

the organic light-emitting diode is connected between the fourth node and a second power source voltage end; and the node initialization module has a control end connected with the first scan line, an input end connected with the initial signal end, and an output end connected between the third node and the second node; and the node initialization module is configured to be controlled by the control end thereof to provide the output end thereof with a signal received at the input end thereof;

wherein the voltage of the reference signal end is positive voltage, and the voltage of the initial signal end is negative voltage;

wherein the driving method comprises:

an initialization stage in which the first transistor in the data writing module is switched on to write a signal of the data signal end into the first node; the fifth transistor in the anode resetting module is switched on to provide the fourth node with a signal of the initial signal end; the fourth switch transistor in the threshold compensation module is switched on to connect the second node with the third node; and the node initialization module provides the second node with the signal of the initial signal end;

a threshold detection stage in which the first transistor in the data writing module is switched on to write a signal of the data signal end into the first node;

the fourth switch transistor in the threshold compensation module is switched on to connect the second node with the third node; the driver transistor in the driver control module is switched on to provide the second node with a signal of the first power source voltage end through the fourth switch transistor in the threshold compensation module to detect a threshold voltage; and if the gate of the fifth transistor in the anode resetting module is connected with the second scan line, then the fifth transistor is switched on to provide the fourth node with a signal of the initial signal end; and a data writing and light emission stage in which the second transistor in the data writing module is switched on to provide the first node with a signal of the reference signal end; the third transistor in the light-emission control module is switched on to connect the third node with the fourth node; and the driver transistor in the driver control module is switched on to drive the organic light-emitting diode to emit light.

18. The driving method according to claim 17, wherein before the initialization stage, the driving method further comprises:

an initial preparation stage in which the node initializing module provides the output end of the node initializing module with a signal of the initial signal end; and if the gate of the fifth transistor in the anode resetting module is connected with the first scan line, then the fifth transistor is switched on to provide the fourth node with the signal of the initial signal end.

* * * * *